US007852227B2

(12) United States Patent
Pepper et al.

(10) Patent No.: US 7,852,227 B2
(45) Date of Patent: Dec. 14, 2010

(54) SYNTHETIC SMOKE GENERATOR AND SMOKE DETECTOR TESTER USING SUCH A GENERATOR

(75) Inventors: Stewart Pepper, Herts (GB); Eddie Ozaki-Owen, Welwyn Garden (GB)

(73) Assignee: Sata Limited, Hertfordshire (GB)

( * ) Notice: Subject to any disclaimer, the term of this patent is extended or adjusted under 35 U.S.C. 154(b) by 489 days.

(21) Appl. No.: 11/721,642

(22) PCT Filed: Dec. 9, 2005

(86) PCT No.: PCT/GB2005/004731

§ 371 (c)(1),
(2), (4) Date: Mar. 6, 2008

(87) PCT Pub. No.: WO2006/064190

PCT Pub. Date: Jun. 22, 2006

(65) Prior Publication Data

US 2009/0273464 A1 Nov. 5, 2009

(30) Foreign Application Priority Data

Dec. 13, 2004 (GB) ..... 0427229.0

(51) Int. Cl.
*G08B 17/10* (2006.01)

(52) U.S. Cl. ..... 340/628; 340/627; 73/1.06; 73/40.7; 392/404

(58) Field of Classification Search ..... 340/628, 340/586, 627, 629, 630; 392/403, 404, 405; 73/1.03, 1.05, 1.06, 40.7
See application file for complete search history.

(56) References Cited

U.S. PATENT DOCUMENTS

| | | | | | |
|---|---|---|---|---|---|
| 3,234,357 | A | * | 2/1966 | Seuthe | 392/403 |
| 3,693,401 | A | * | 9/1972 | Purt et al. | 73/1.05 |
| 3,891,826 | A | * | 6/1975 | Seuthe et al. | 392/405 |
| 4,271,693 | A | * | 6/1981 | Bute | 73/1.03 |
| 5,922,944 | A | * | 7/1999 | Pieroni et al. | 73/40.7 |
| 6,142,009 | A | * | 11/2000 | Loblick | 73/40.7 |
| 2004/0035179 | A1 | * | 2/2004 | Koch | 73/1.05 |

FOREIGN PATENT DOCUMENTS

| | | |
|---|---|---|
| EP | 1281957 A1 | 2/2003 |
| GB | 2299005 | 9/1996 |

* cited by examiner

*Primary Examiner*—Travis R Hunnings
(74) *Attorney, Agent, or Firm*—Koppel, Patrick, Heybl & Dawson

(57) ABSTRACT

The present invention relates to an electrically operated device for generating synthetic smoke and also to a hazard detector tester utilizing such a device. The device comprises a collapsible container provided with vaporisable liquid and a tube, one end of which is immersed in the liquid and the other end of which is provided with an electrical heater for vaporising the liquid in the other end of the tub in order to generate smoke. A peristaltic pump is used to pump the liquid through the tube.

15 Claims, 1 Drawing Sheet

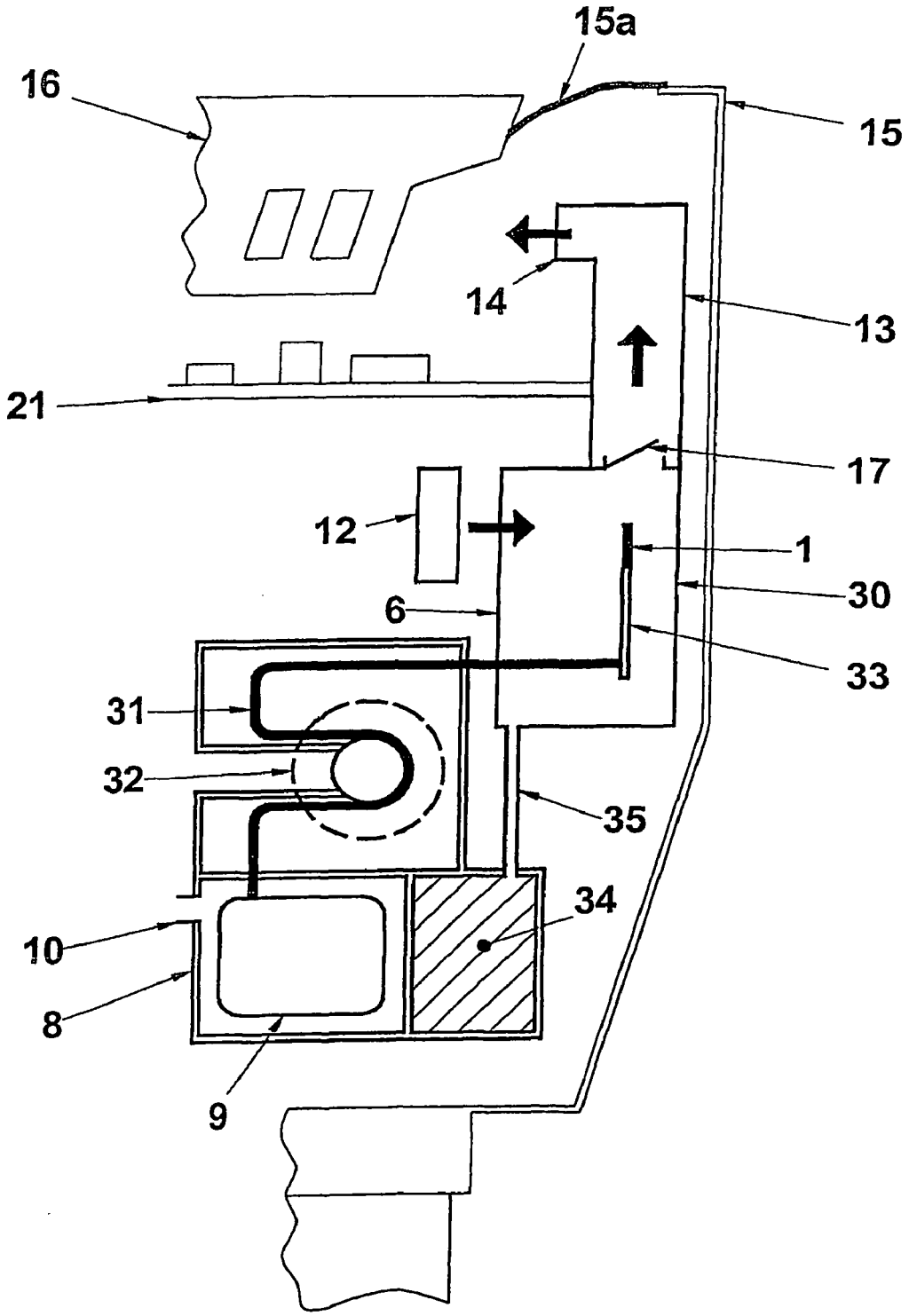
15a
16
15
14
13
21
17
12
1
30
6
33
31
32
35
34
10
8
9

SYNTHETIC SMOKE GENERATOR AND SMOKE DETECTOR TESTER USING SUCH A GENERATOR

BACKGROUND OF THE INVENTION

1. Field of the Invention

The present invention relates to a device for generating synthetic smoke and also to a hazard detector tester utilising such a device.

2. Description of the Related Art

In the past, hazard detectors such as smoke detectors, have been tested by utilising an aerosol of fine particles dispensed from a pressurised can. One such tester is the one sold under the trade name 'Trutest' where an aerosol container is discharged into an intermediate chamber to accumulate the aerosol particles prior to delivering them through to the detector. However, the use of pressurized containers is not particularly convenient as they are classified as 'hazardous' and hence costly to transport. Also, the propellants used cause difficulty either because they are flammable, are greenhouse gases or attack the ozone layer. While it is possible to utilise suitable propellants and so overcome any environmental issues, there is a market for an alternative to the use of pressurized containers in certain circumstances.

It has previously been proposed in GB 2299005 to provide a device for vaporising liquids in order to produce synthetic smoke utilising an electrically heated heat exchanger. In this prior proposal, smoke-producing fluid which is to be vaporised is forced into a thin-walled metal tube by means of a pump, compressed air or gravity and the tube is connected to a source of current in order to directly heat the liquid in the tube.

A further proposal for generating synthetic smoke electrically is disclosed in U.S. Pat. No. 3,891,826 and utilises a capillary tube one end of which sits in a reservoir of liquid. Within the capillary tube is located a further tube and the gap between the outer wall of the further tube and the inner wall of the capillary tube creates an annular space which has capillary dimensions and which draws the liquid up into the annular space where it is heated by an electrically operated heated element housed within the further tube. This particular arrangement requires that there is a small head of liquid to feed into the capillary space. This renders it inappropriate for use in a device which might be tilted or inverted during use.

BRIEF DESCRIPTION OF THE DRAWING

FIG. 1 is a schematic sectional side view of a smoke detector tester in accordance with one embodiment of the invention.

DETAILED DESCRIPTION OF THE INVENTION

It is an object of the present invention to provide an electrically operated synthetic smoke generator which avoids the disadvantages of the prior arrangements.

From a further aspect, the present invention provides an apparatus for testing a hazard detector comprising, for example, an open-topped housing for receiving a detector under test, the housing containing a smoke generator device, a chamber for receiving smoke generated by the generator device and means for directing the smoke in the receiving means towards the detector under test, characterised in that the smoke generator device comprises a source of vaporisable liquid, a tube one end of which is immersed in the source of liquid and the other end of which is provided with an electrical heater for vaporising the liquid in said other end in order to generate smoke. Other arrangements of the present invention to perform the function of hazard detector testing are also possible. It could be either fixed in location at or near a hazard detector or it could be portable. The invention is adaptable to enable testing of many different arrangements of hazard detector, including point type detectors or those mounted in a duct or based on air sampling.

In order that the present invention be more readily understood, an embodiment thereof will now be described by way of example with reference to the accompanying drawings, in which the FIGURE shows a schematic sectional side view of a smoke detector tester according to the present invention.

The preferred embodiment of the present invention is a smoke detector tester of a type which is portable and is capable of being mounted on the end of a pole so as to be lifted into the test condition by an operator standing on the ground while the detector under test is located on, for example, a ceiling. The tester is designed to cause a sample of test synthetic smoke to be emitted in the vicinity of a detector under test to cause the detector to be activated. It may be tilted to access detectors in awkward positions, or even inverted during use.

Turning now to the FIGURE, a detector under test is indicated by the reference numeral 16. A smoke detector tester includes a cup shaped housing 15 which has a flexible membrane 15*a* with an opening of a size and shape capable of receiving the detector 16. The membrane has sufficient flexibility to allow for a range of different detector samples.

Within the housing 15 there is provided a synthetic smoke generator generally indicated by the reference numeral 30. As shown, the generator is housed in a chamber 6 in a lower portion of the cup shaped housing 15 and communicates with the upper portion of the housing 15 by means of a duct 13 which has a horizontally directed outlet 14 for directing the synthetic smoke directly towards the detector 16 under test. This simulates the effect of smoke drifting across a ceiling or wall and entering a ceiling or wall-mounted detector during a fire. If desired, a spacer (not shown) may be provided in order to accurately locate the outlet 14 with respect to the detector.

The synthetic smoke generator comprises a reservoir housing 8 arranged to contain a vaporisable fluid in an airtight collapsible bag 9. The fluid used is preferably a mixture of some or all of propylene glycol, di-propylene glycol, poyethylene glycol and water. In addition, other components may be added to give suitable smoke characteristics. An air vent hole 10 in the reservoir housing 8 allows the bag to collapse as the fluid in the bag 9 is consumed. Fluid is supplied to the smoke generator 30 by means of a tube 31 which depends into the bag 9 and has at least a portion of its length subjected to the action of a pump which is preferably a peristaltic pump 32. The tube supplies the smoke generator 30 which is preferably in the form of a vitreous tube 33 provided with an electrically activated heater.

The tube 33 is located in the chamber 6 which is subjected to the action of a fan or blower 12 to increase the pressure in the chamber 6. This will cause synthetic smoke in the chamber 6 to move into the duct 13 and out of the outlet 14 with the necessary velocity. In use, vaporisable fluid moves from the collapsible bag 9 through the tube 31 into the region of the heating element 1 under the action of the peristaltic pump 32. When the heating element is connected to a source of current, the heating element vaporises the fluid in vitreous tube 33 in the region of the heating element which causes a synthetic smoke, actually a fog or mist, to be emitted from the top of the chamber 6. The fan or blower 12 is arranged to blow the synthetic smoke into the duct 13 and thence to the outlet 14 at sufficient speed to ensure that the detector 16 is activated promptly The flow of smoke from the chamber 6 into the duct 13 may be regulated by a flap valve 17 which can be opened and closed in a controlled fashion. In the present embodiment, control of the flap valve is achieved by utilising an actuating wire made from a shape memory alloy, trade name Flexinol, which contracts in length by an appreciable amount (typically 5%) when heated by passing an electric current through it. This contraction causes the flap valve to open. The valve is normally held closed by a spring (not shown). The tester is preferably battery powered and the batteries are most conveniently located in a support pole at a position adjacent the tester body to reduce voltage drop between the batteries and the tester.

Control of the currents to the heating element, the fan 12, pump 32 and the valve actuating wire is accomplished using control circuitry on an electronic circuit board 21 which is arranged to control the heating element and pump to govern the attributes of the smoke generated. Fluid, when pumped into the tube 33 is boiled with the resulting vapour passing into the chamber 6 where it condenses to form a fog. The fan assists in condensation. Any large droplets of fluid or splashes which emerge from the top of the tube 33 or which arise from condensation on the side walls of the chamber 6 will run down the interior walls of the chamber 6 to the bottom where they are preferably channelled into a sponge 34 through tube 35. Sponge 34 can be housed in the reservoir housing 8 for convenience. Although not shown, the reservoir housing 8 can be replaced when the supply of fluid in the collapsible bag 9 is exhausted. Also, with the sponge 34 housed in the reservoir housing 8, the sponge 34 is replaced at the same time, removing the need to replace it separately when or if it becomes saturated. Also, if the tube 31 is housed within the reservoir housing 8, it too is replaced at the same time the fluid supply is replaced, thus eliminating the possibility of malfunction of the pump due to wear of the tube.

The above arrangement has the advantage that the synthetic smoke can be produced continually and the amount of synthetic smoke actually dispensed is controlled by operation of the valve 17 and the fan 12. This is in contrast to previous arrangements where the amount of smoke produced was totally dependent on the amount of smoke instantaneously generated by the generator. Alternatively, the synthetic smoke can be produced as required and dispensed instantaneously if desired, controlled by operation of the element 1 and the fan 12, without the need for the valve 17.

After the hazard detector has successfully been activated using the synthetic smoke, it may be necessary to clear the smoke from inside the detector so that the detector or alarm signal can be reset. This may be done expediently with the present invention by using the fan 12 to blow clean air through duct 13 and out of outlet 14 into the detector. The smoke generation will not be operational at this time.

We claim:

1. Apparatus for testing a hazard detector comprising a housing containing a smoke generator device, a chamber for receiving smoke generated by the generator device and a duct for directing the smoke towards the detector under test, characterised in that the smoke generator device comprises a collapsible container provided with vaporisable liquid and a tube, one end of which is immersed in the liquid and the other end of which is provided with an electrical heater for vaporising the liquid in the other end in order to generate smoke.

2. Apparatus according to claim 1, and comprising a pump for causing liquid to move from the container to the other end of the tube.

3. Apparatus according to claim 2, wherein the pump is a peristaltic pump and the tube has at least a portion which is subjected to the action of the pump.

4. Apparatus according to claim 1, and comprising control means for controlling the amount of smoke directed towards the detector under test.

5. Apparatus according to claim 4, wherein the control means includes a valve arrangement communicating with the duct.

6. Apparatus according to claim 5, and comprising a fan arrangement for causing smoke to be emitted from the duct.

7. Apparatus according to claim 6, wherein the control means is arranged to control the fan.

8. Apparatus according to claim 1, and comprising a fan arrangement for causing smoke to be emitted from the duct.

9. Apparatus according to claim 1, wherein the collapsible container is removable from the apparatus.

10. Apparatus according to claim 9, wherein the collapsible container is in the form of a cartridge.

11. Apparatus according to claim 10, wherein the cartridge includes at least part of the tube.

12. Apparatus according to claim 11, wherein a collection means is provided for collecting condensed or excess liquid in the chamber.

13. Apparatus according to claim 1, wherein a collection means is provided for collecting condensed or excess liquid in the chamber.

14. A method of testing a hazard detector comprising placing apparatus as defined in any one of the preceding claims in the vicinity of a detector to be tested, generating smoke and causing the generated smoke to move generally parallel to the surface on which the detector is mounted.

15. A method of testing according to claim 14, wherein smoke is cleared from the chamber after smoke generation is terminated at the end of a test.

* * * * *